US012637630B1

(12) United States Patent
McDonald et al.

(10) Patent No.: US 12,637,630 B1
(45) Date of Patent: May 26, 2026

(54) METALLIZED HYDROXYL TERMINATED, EPOXIDIZED POLYBUTADIENE SOLID FUEL RAMJET FUEL

(71) Applicants: Brian A. McDonald, Taft, TN (US); Jeremy R. Rice, Huntsville, AL (US); Terry Pruett, Elora, TN (US); Jason Wachs, Redstone Arsenal, AL (US); Kenneth Lawrence Pledger, Huntsville, AL (US); Wayne Steelman, Hazel Green, AL (US); Dan Jones, Prairie Village, KS (US); Jerry Durham, Hazel Green, AL (US); Brian Hayes, Rockford, MI (US)

(72) Inventors: Brian A. McDonald, Taft, TN (US); Jeremy R. Rice, Huntsville, AL (US); Terry Pruett, Elora, TN (US); Jason Wachs, Redstone Arsenal, AL (US); Kenneth Lawrence Pledger, Huntsville, AL (US); Wayne Steelman, Hazel Green, AL (US); Dan Jones, Prairie Village, KS (US); Jerry Durham, Hazel Green, AL (US); Brian Hayes, Rockford, MI (US)

( * ) Notice: Subject to any disclaimer, the term of this patent is extended or adjusted under 35 U.S.C. 154(b) by 0 days.

(21) Appl. No.: 19/034,833

(22) Filed: Jan. 23, 2025

(51) Int. Cl.
*C10L 5/40* (2006.01)

(52) U.S. Cl.
CPC ..... *C10L 5/406* (2013.01); *C10L 2230/22* (2013.01); *C10L 2250/04* (2013.01); *C10L 2270/04* (2013.01)

(58) Field of Classification Search
CPC .. C10L 5/406; C10L 2230/22; C10L 2250/04; C10L 2270/04
See application file for complete search history.

(56) References Cited

U.S. PATENT DOCUMENTS 10,591,950 B2 3/2020 McDonald
2023/0093642 A1* 3/2023 Swanson ..... F42B 15/10 60/219

FOREIGN PATENT DOCUMENTS

CN 111170816 A * 5/2020 ..... C06B 33/06
CN 112814807 A * 5/2021 ..... F02K 1/80

OTHER PUBLICATIONS

C. Young et al. "Ignition and Combustion Enhancement of Boron with Polytetrafluoroethylene". Journal of Propulsion and Power. vol . 31. No. 1. Jan.-Feb. 2015 (Year: 2015).*

B. A. McDonald and J. Rice, "Solid fuel ramjet fuel optimization for maximum impulse-density with respect to air to fuel ratio and relative fuel regression tes derived from thermogravimetric analysis," Aerospace Science and Technology, vol. 86, pp. 478-486, 2019.

(Continued)

*Primary Examiner* — Latosha Hines

(57) ABSTRACT

A Ramjet solid fuel comprising up to 50% metal by weight selected from the group consisting of aluminum, boron, boron carbide, magnesium, titanium, and titanium boride; between 2.0 and 9.0 weight percent fluorinated combustion aids selected from the group consisting of 3-hydroxybenzo trifluoride (3HBTF), hydroxyfluoro-2-propanol ($HF_2P$), polytetrafluoroethylene, and trifluoroethanol (TFE); and up to 48% by weight of the remaining component being a hydroxyl terminated, epoxidized polybutadiene polymer (Poly BD 605E) (HO—CH2-CH═CH—CH2-CH2-CH—O—CH—CH2-CH2-CH—(CH═CH2)-CH2-CH═CH—CH2-CH2-CH—O—CH—CH2-OH).

2 Claims, 13 Drawing Sheets

(56) References Cited

OTHER PUBLICATIONS

B. McDonald and J. Rice, "Solid fuel ramjet fuel optimization for maximum thrust to drag ratio and impulse density subject to geometric restraints on missile (continued below)outer mold line," Aerospace Science and Technology, p. 75, 2018.
B.A. McDonald, J. Rice and J. Stewart, "Mechanical and thermodynamic characteristics of a copolymer of LP-33 polysulfide and hydroxyl terminated polybutadiene for solid fuel ramjet applications," Combustion and Flame, vol. 184, pp. 11-19, 2017.
B. McDonald, R. Rice, B. Hayes, C. Marshall, L. Pledger, D. Myers and D. Jones, "High density solid fuel ramjet fuel based on 1,6-hexanediol diglycidyl ether and methyltetrahydrophtha.kc anhydride," Fuel, vol. 278, p. 118354, 2020.

* cited by examiner

| | |
|---|---|
| 3A | HDGE_Al(40%) |
| 3B | HDGE_PTFE_Al(40%) |
| 3C | HDGE_TFE_Al(40%) |
| 3D | HDGE_HBTF_Al(40%) |
| 3E | HDGE_HF2P_Al(40%) |

FIG. 3c

| | |
|---|---|
| | C* Efficiency |
| | Pressure Integral / unit volume of fuel |
| 4A | 605_HF2P_AL(25%) |
| 4B | 605_HBTF_AL(25%) |
| 4C | 605_AL(25%) |

FIG. 4b

| | |
|---|---|
| 5A | Test 1 - 605_B4C (40%) |
| 5B | Test 2 - 605_B4C (40%) |
| 5C | Test 3 - 605_Unloaded Test 3 |

FIG. 5b

| | |
|---|---|
| □ | Test 1 - B4C (40%) |
| ● | Test 2 - B4C (4%)<br>Test 2 Vitlator Failure |
| ○ | Test 3 - GUM |
| ■ | Test 4 - B4C (40%) |
| ◇ | Test 5 - Al (25%) |
| ▲ | Test 6 - Al (10%) |
| △ | Test 7 - Al (25%)<br>Burst Disk Failure |
| ✳ | Test 8 - Al (25%) |
| ◆ | Test 9 - Al (25%)<br>Iscyanate |
| ☆ | Test 10 - Al (25%)<br>Inlet Temperature too low |
| ⬭ | Note B region |

FIG. 6b

| | |
|---|---|
| ◇ | Test 1 |
| ■ | Test 3 |
| ◆ | Test 4 |
| □ | Test 5 |
| ● | Test 6 |
| ▲ | Test 7 |
| ✳ | Test 8 |
| ○ | Test 9 |
| △ | Test 10 |

FIG. 7b

METALLIZED HYDROXYL TERMINATED, EPOXIDIZED POLYBUTADIENE SOLID FUEL RAMJET FUEL

BACKGROUND

The current state of the art solid fuel Ramjet (SFRJ) fuel polymer is hydroxyl terminated polybutadiene (HTPB). This material has several distinct advantages in both the SFRJ and conventional solid rocket motor (SRM) applications, to include excellent energy density, stable combustion, and a low glass transition temperature. However, HTPB has a relatively low material density and a high stoichiometric air to fuel ratio (AF). Design trade studies have shown that as the flight speed increases, the optimum stoichiometric fuel ratio tends towards lower values for both the metal additive and the polymer. Likewise, performance is optimized when the stoichiometric AF closely matches the metal additive. At the higher metal loadings, combustion aids become imperative.

DETAILED DESCRIPTION

Figure 1:
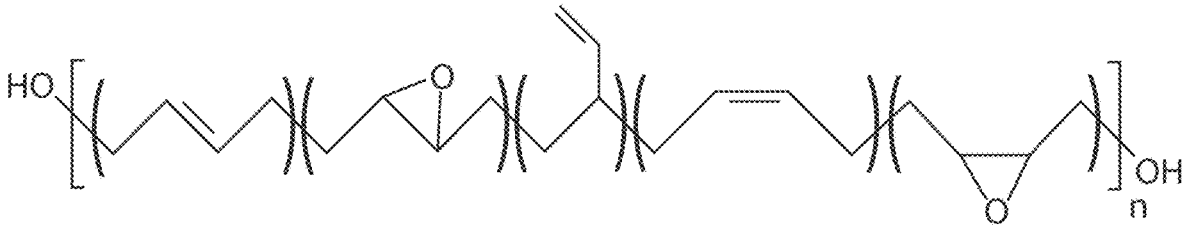
FIG. 1 shows the polymer structure for PolyBD 605E (HO—CH2-CH═CH—CH2-CH2-CH—O—CH—CH2-CH2-CH(CH═CH2)-CH2-CH═CH—CH2-CH2-CH—O—CH—CH2-OH).

The inventors of this work have developed a SFRJ fuel that maximizes total impulse for a given volumetric constraint on the combustion chamber, while demonstrating consistent ignition and stable combustion. Likewise, the material has been found to be conducive to the addition of solid particulate at high mass fractions. The cured polymer matrix exhibited acceptable mechanical properties over a wide range of storage and operational temperature conditions.

A metallized SFRJ fuel has been developed using a hydroxyl terminated, epoxidized polybutadiene polymer. The dual functionality of the polymer allows crosslinking by several curatives and reaction mechanisms. The polymer has a higher density than conventional fuel polymers. Formulations have been prepared with up to 40% boron carbide or aluminum powder and incorporate fluorinated combustion aids to include 3-hydroxybenzotrifluoride, trifluoroethanol, or hexafluoro-2-propanol. Direct connect combustion testing of fuel grains made with the formulations have shown stable combustion and consistent ignition. Successful combustion testing has been demonstrated at subscale and full-scale geometries. Fuel regression rates are consistent and within an acceptable range.

Testing of candidate SFRJ polymer was performed and showed an increase in total impulse over conventional materials by way of increased energy density and/or an increase in material density. The hydroxyl terminated, epoxidized polybutadiene polymer Poly BD 605E (605E) (HO—CH2-CH═CH-CH2-CH2-CH—O—CH—CH2-CH2-CH(CH═CH2)-CH2-CH═CH—CH2-CH2-CH—O—CH—CH2-OH) was purchased from Chem Spec of Uniontown, OH. It became the candidate based on its density, butadiene structure, and the inclusion of both epoxide and hydroxyl functional groups. Butadiene materials have historically proven to be excellent fuel materials. With the dual nature of the functional groups, multiple curing mechanisms could be utilized. Formulations are prepared with up to 50% of various metallized fuels but have focused primarily on boron carbide or aluminum powder. A unique feature of the polymer was the inclusion of hydroxyl functional end groups and oxirane groups along the polymer backbone. This feature allowed for the reaction of fluorinated alcohols, used for combustion aids, directly to the polymer backbone, while leaving the terminal hydroxyl groups for crosslink relations with conventional isocyanate curatives, such as isophorone diisocyanate, hexamethylene diisocyanate, or 2,4,4,-trimethylhexamethylene diisocyanate, as examples.

The purpose of the work was to develop an SFRJ fuel polymer that maximizes total impulse for a given volumetric constraint on the combustion chamber, while demonstrating consistent ignition and stable combustion. Likewise, the material needed to be conducive to the addition of solid particulate at high mass fractions. The cured polymer matrix needed to exhibit acceptable mechanical properties over a wide range of storage and operational temperature conditions.

One feature of this application was the use of the hydroxyl terminated, epoxidized polybutadiene polymer, Poly BD 605E. The polymer was cured with isocyanates, anhydrides, and epoxides. In each case, the resulting material has shown unique properties that can be tailored in a wide range of Shore-A hardness values. Of significance was the inclusion of hydroxyl functional fluorinated alcohols into the polymer matrix by way of reaction with the epoxide functional groups on the polymer backbone. Because of the unique dual functional nature of this polymer, these combustion aids could be attached to the polymer backbone in a pre-reaction, leaving the terminal hydroxyl groups on the polymer available for crosslinking via a urethane reaction with conventional isocyanates. The material was loaded with metal fuel additives up to a mass fraction of 50%. The density of the polymer was approximately 12% higher than the R-45M HTPB and had a slightly lower stoichiometric AF and thus tended to show a slight increase in theoretical performance as the cruise Mach number was increased.

The distinct advantage of this material was the versatility afforded by the dual functionality. Multiple curing mechanisms could be incorporated leaving additional functional sites that allowed for further modification of the material by way of such things as combustion aids. The material had a lower stoichiometric AF than conventional materials which tend to allow it to optimize at higher flight Mach numbers, according to some analyses. The material had exhibited consistent ignition and stable combustion in small fuel grains and at full scale geometry. Likewise, this combustion performance has been demonstrated over a large range of chamber pressures, inlet temperatures, and air mass flux values. The material has shown excellent combustion with metal additives to include aluminum, boron, boron carbide, magnesium, titanium, and titanium diboride.

Table 1 shows fuel formulations of the 605E polymer that have been tested in combustion trials. The formulations include aluminum and boron carbide at several mass fractions, and the inclusion of four different fluorinated combustion aids.

TABLE 1

| Label | Polymer | HBTF (%) | $HF_2P$ (%) | TFE (%) | PTFE (%) | $B_4C$ (%) | Aluminum (%) |
|---|---|---|---|---|---|---|---|
| 605 B4C (40%) | 605 | | | | | 40 | |
| 605 PTFE $B_4C$ (40%) | 605 | | | | 6.1 | 40 | |
| 605 TFE $B_4C$ (40%) | 605 | | | 8.1 | | 40 | |
| 605 HBTF $B_4C$ (40%) | 605 | 13.1 | | | | 40 | |
| 605 $HF_2P$ $B_4C$ (40%) | 605 | | 6.8 | | | 40 | |
| 605 $HF_2P$ Al (25%) | 605 | | 4.5 | | | | 25 |
| 605 HBTF Al (25%) | 605 | 8.8 | | | | | 25 |
| 605 Al (25%) | 605 | | | | | | 25 |
| 605 $HF_2P$_AL (10%) | 605 | | 1.7 | | | | 10 |

FIG. 1 shows the basic structure of the Poly BD 605E. Seen in FIG. 1 are the hydroxyl terminal groups, the epoxides along the backbone, and the butadiene linkages.

Figure 2A:
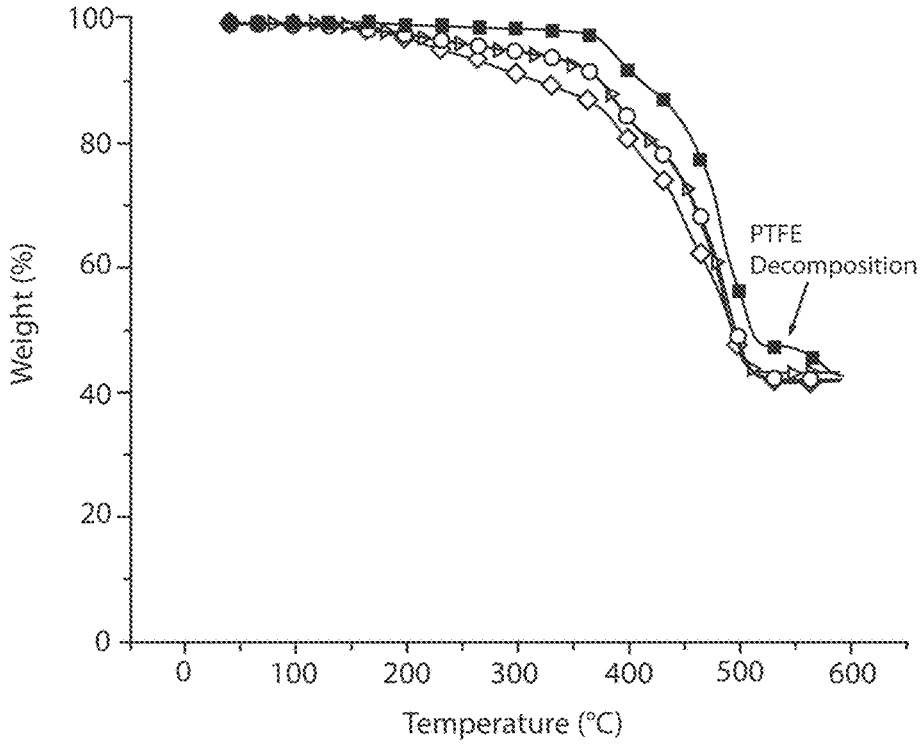
FIG. 2 is an xy graph showing Thermogravimetric Analysis (TGA) and Differential Thermal Gravimetry (DTG) results for fuel samples of 605-40% $B_4C$ with various combustion aids.
Figure 2B:
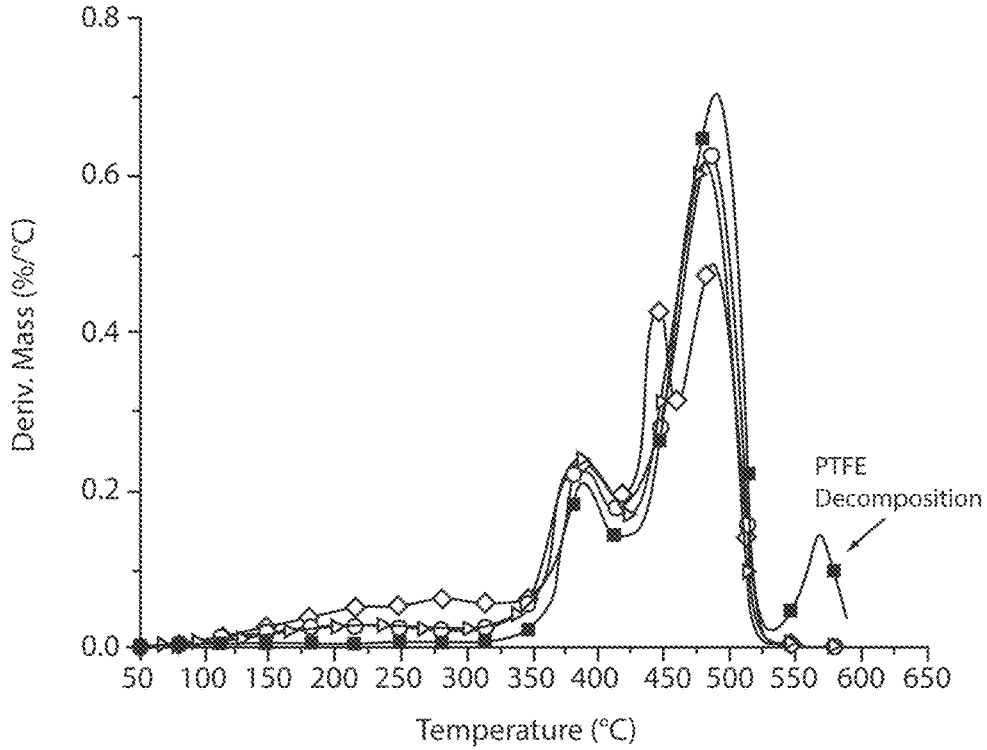
Figure 2C:
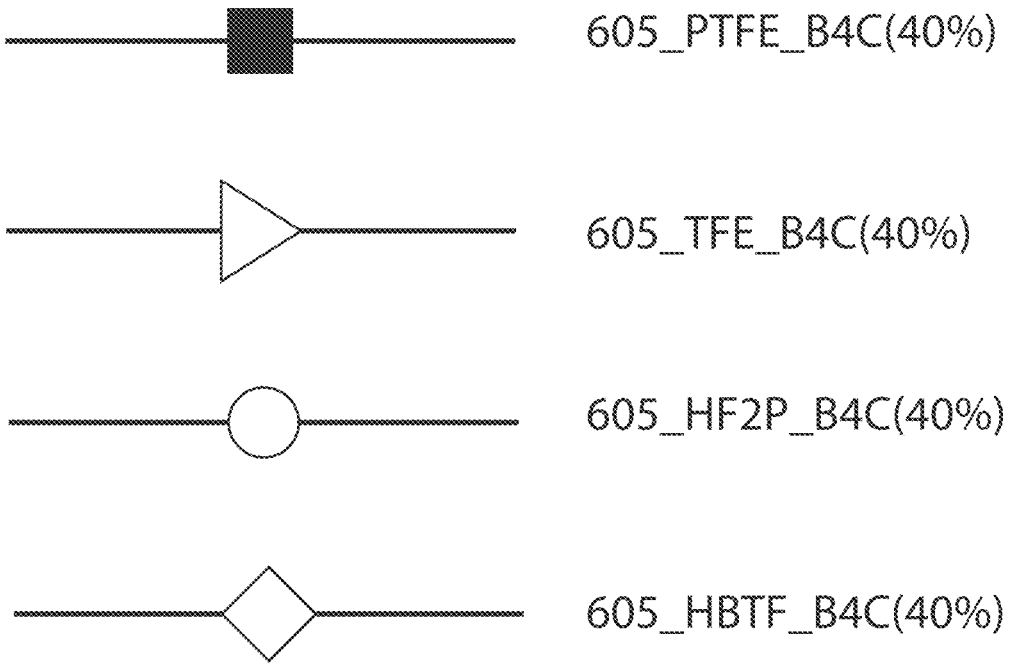

FIG. 2. shows TGA and DTG results for fuel samples of Poly BD 605 with 40% $B_4C$ and the various combustion aids shown in Table 1: hydroxybenzotrifluoride (HBTF), trifluoroethanol (TFE), hydroxyfluoro-2-propanol ($HF_2P$), and polytrifluoroethanol (PTFE).

Figure 3A:
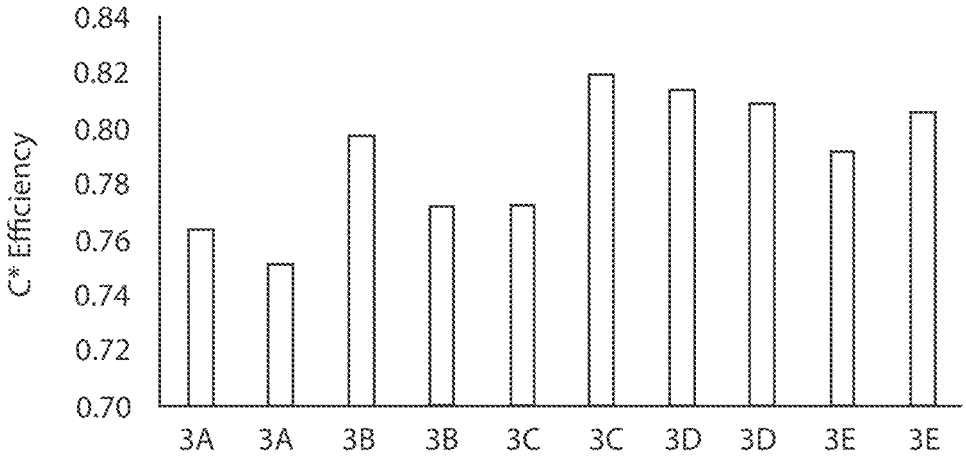
FIG. 3 is an xy graph showing TGA results of mass loss versus temperature for the 605 and $B_4C$ formulation containing the fluorinated combustion aids as shown in Table 1.
Figure 3B:
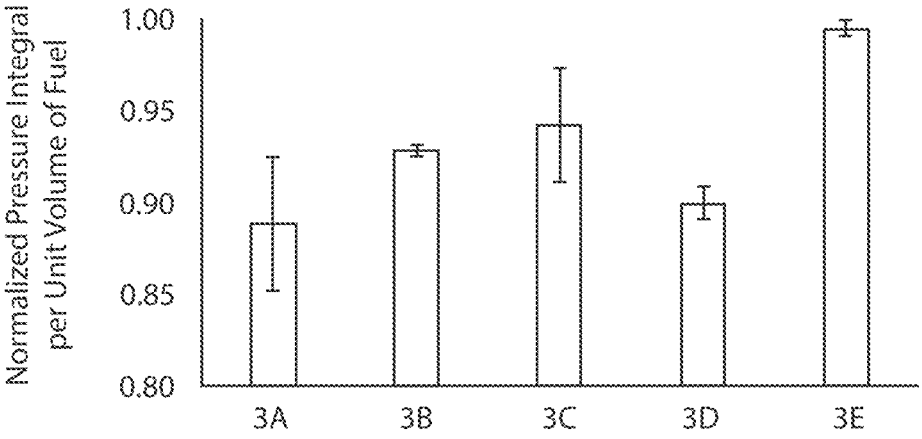

FIG. 3 shows TGA mass loss versus temperature for the Poly BD 605 and $B_4C$ formulations containing the fluorinated combustion aids as shown in the Table 1: HBTF, TFE, $HF_2P$, and PTFE.

Figure 4A:
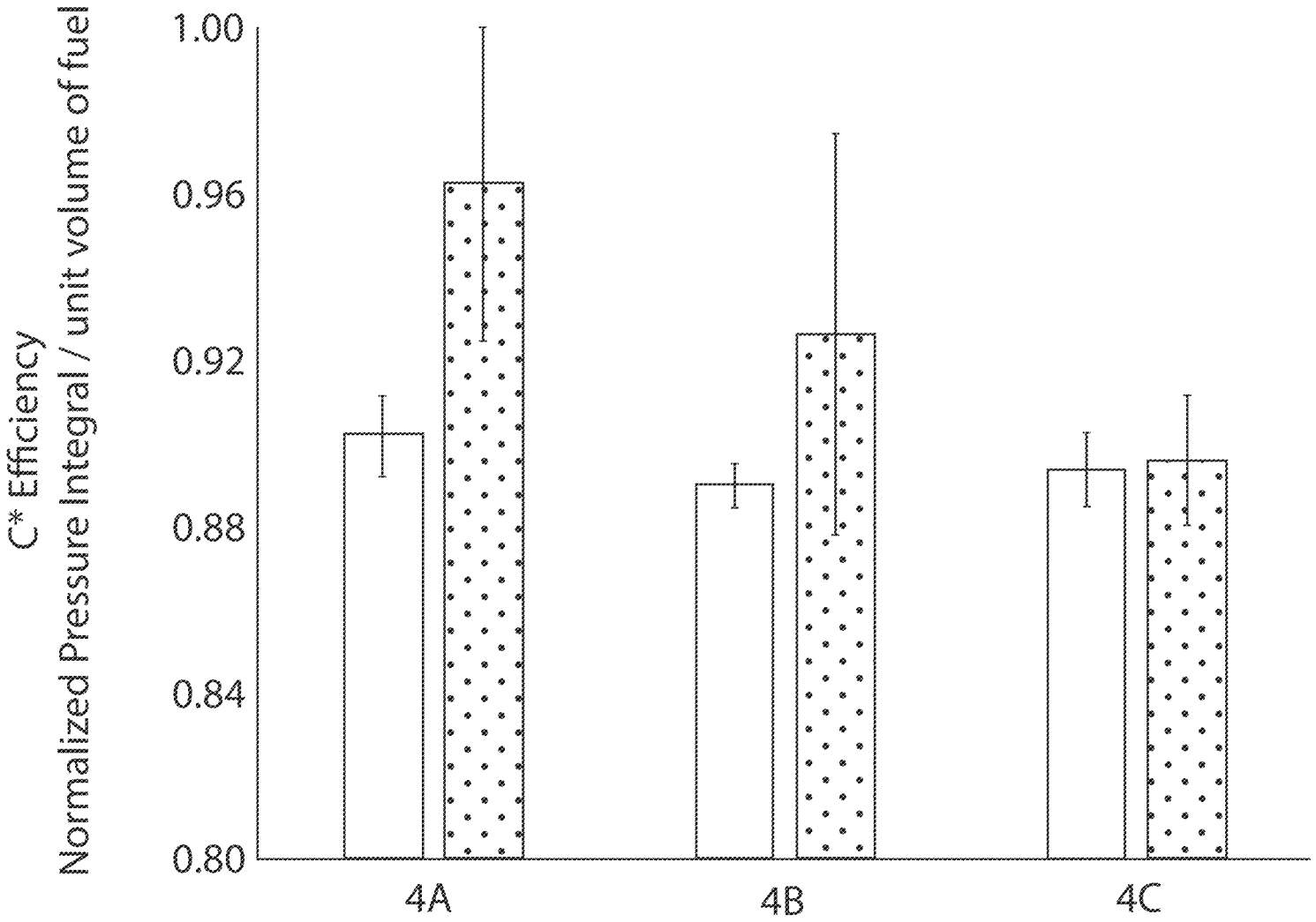
FIG. 4 is a graph showing C* Efficiency of HDGE_Al (Aluminum in a hexane glycidyl ether formulation).

FIG. 4 shows the characteristic exhaust velocity (C*) efficiency which is the ratio of the delivered C* to the theoretical C* at an equivalent pressure, equivalence ratio, and initial fuel/air mixture temperature. This data is collected on 2"×6" SFRJ test motors in direct connect testing. The multiple formulations in FIG. 4 demonstrate the versatility and performance of the material. The multiple formulations include: HDGE_AL(40%); HDGE_PTFE_Al(40%), HDGE_TFE_Al(40%), HDGE_HBTF_AL(40%), and HDGE_$HF_2P$_Al(40%).

Figure 5A:
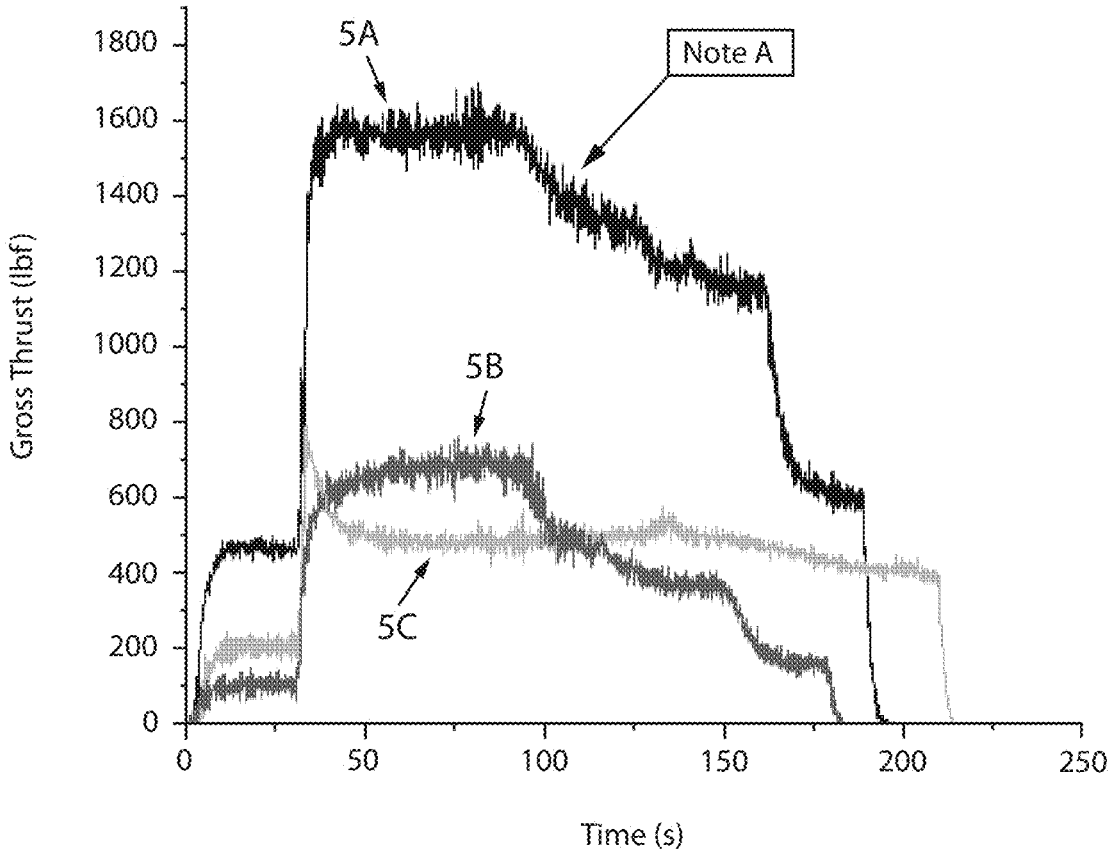
FIG. 5 is a graph showing HDGE_AI Normalized Pressure Integral Density.

FIG. 5 show the normalized chamber pressure integral per unit volume of fuel or pressure integral density for the replicate averages of each formulation: HDGE_Al(40%), HDGE_PTFE_Al(40%), HDGE_TFE_Al(40%), HDGE_HBTF_Al(40%), and HDGE_$HF_2P$_Al(40%). The pressure integral per unit volume is proportional to the impulse density of the fuel.

Figure 6A:
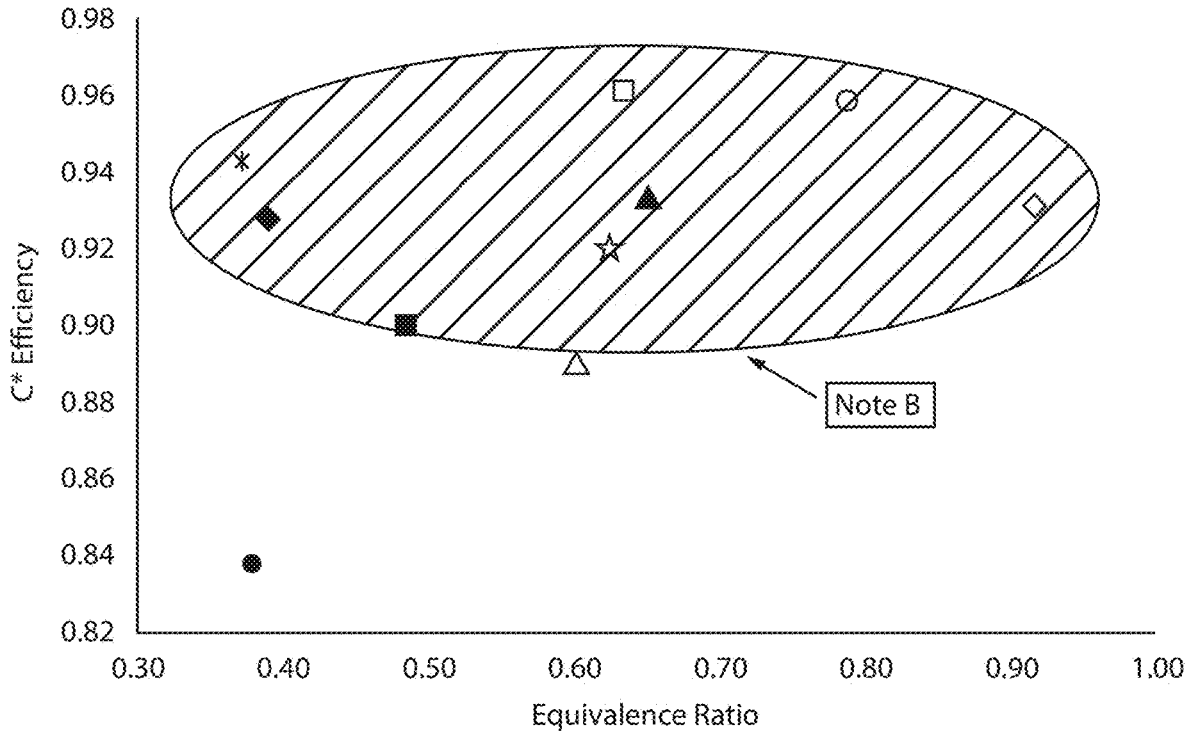
FIG. 6 is a graph showing C* Efficiency and normalized pressure integral per unit volume of fuel for formulations of HDGE and 25% Al.

FIG. 6 shows the C* efficiency compared to the normalized chamber pressure integral per unit volume of fuel or pressure integral density for the replicate averages of each formulation. The pressure integral per unit volume is proportional to the impulse density of the fuel. The formulations include 605_$HF_2P$_AL(25%); 605_HBTF_AL(25%); and 605_AL(25%) (i.e., 605 indicates PolyBD 605E, the commercial name for an epoxidized polybutadiene, hexanediol diglycidyl ether). FIG. 6 shows C* Efficiency and normalized pressure integral per unit volume of fuel for formulations of HDGE and 25% Al. In FIG. 6 the aluminum content is reduced to 25% for formulations containing HBTF and $HF_2P$ for comparison to a baseline 605_AL(25%).

Figure 7A:
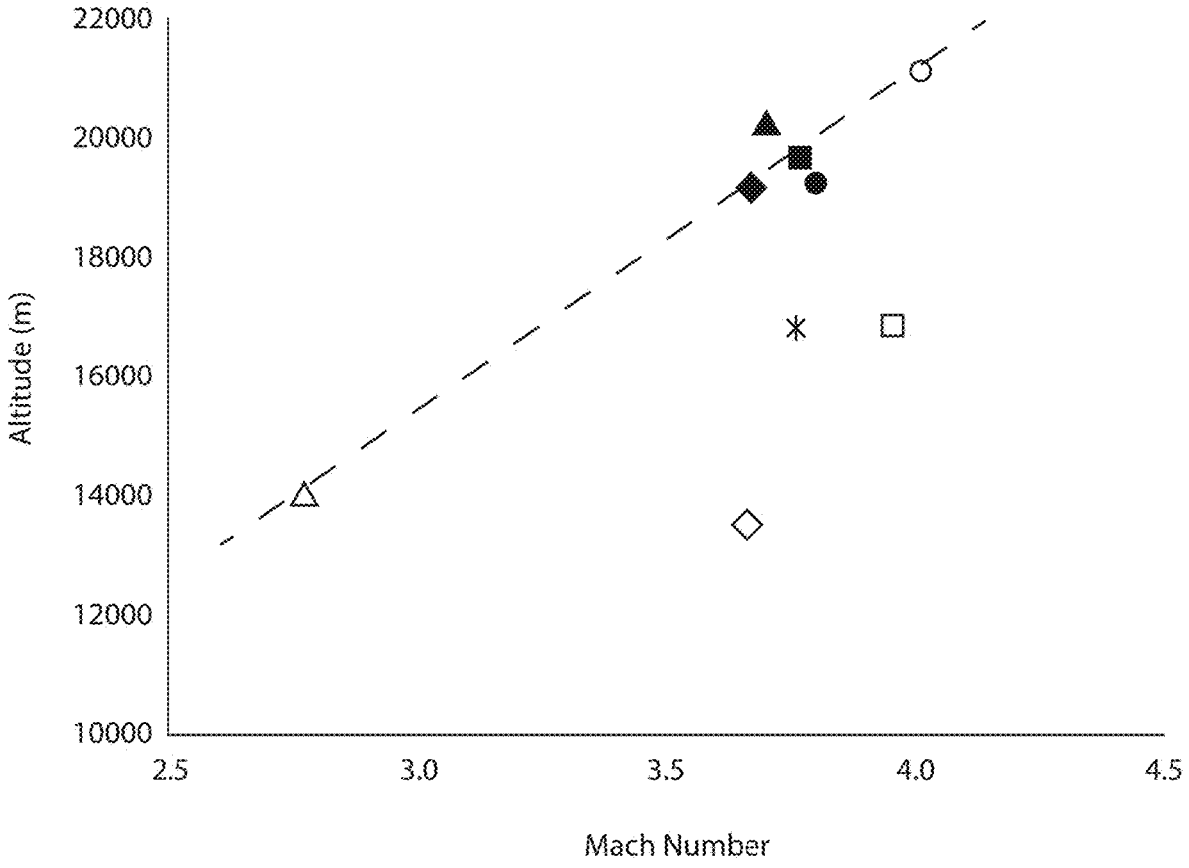
FIG. 7 is a graph plotting combustion testing of full scale SFRJ motor using PolyBD 605E polymer with boron carbide and a fluorinated alcohol combustion aid.

FIG. 7 shows the results of combustion testing of full scale SFRJ motor using Poly BD 605E polymer with boron carbide and a fluorinated alcohol combustion aid. FIG. 6 shows the thrust measurements for three full scale SFRJ direct connect motor firings. In each of these firings, the formulation contained 40% $B_4C$ powder and 13.1% 3-hydroxybenzotrifluorride attached to the 605 backbone oxirane groups. Test 1 used 605_$B_4C$ (40%). Test 2 used 605_$B_4C$ (40%). Test 3 used 60%_Unloaded.

In one embodiment, the present application relates to a Ramjet solid fuel comprising up to 50% metal by weight selected from the group consisting of aluminum, boron, boron carbide, magnesium, titanium, and titanium boride; between 2.0 and 9.0 weight percent fluorinated combustion aids selected from the group consisting of 3-hydroxybenzo trifluoride (3HBTF), hydroxyfluoro-2-propanol ($HF_2P$), polytetrafluoroethylene, and trifluoroethanol (TFE); and up to 48% by weight of the remaining component being a hydroxyl terminated, epoxidized polybutadiene polymer (Poly BD 605E) (HO—CH2-CH═CH—CH2-CH2-CH—O—CH—CH2-CH2-CH—(CH═CH2)-CH2-CH═CH—CH2-CH2-CH—O—CH—CH2-OH).

In another embodiment of the application relating to the Ramjet solid fuel, the hydroxyl terminated, epoxidized polybutadiene polymer (Poly BD 605E) of the Ramjet solid fuel is cured with isocyanate curatives selected from the group consisting of isophorone diisocyanate, hexamethylene diisocyanate, or 2,4,4-trimethylhexamethylene diisocyanate.

In yet another embodiment, the application relates to a method of using a hydroxyl terminated, epoxidized polybutadiene polymer (Poly BD 605E) (HO—CH2-CH═CH—CH2-CH2-CH—O—CH—CH2-CH2-CH—(CH═CH2)-CH2-CH═CH—CH2-CH2-CH—O—CH—CH2-OH) to achieve an SFRJ having functional sites to perform both curing and further modification of the material with combustion aids, comprising the steps of combining up to 50% metal by weight selected from the group consisting of aluminum, boron, boron carbide, magnesium, titanium, and titanium boride; between 2.0 and 9.0 weight percent fluorinated combustion aids selected from the group consisting of 3-hydroxybenzo trifluoride (3HBTF), hydroxyfluoro-2-propanol ($HF_2P$), polytetrafluoroethylene, and trifluoroethanol (TFE); and the remaining component being up to 48% by weight of a hydroxyl terminated, epoxidized polybutadiene polymer (HO—CH2-CH═CH—CH2-CH2-CH—O—CH—CH2-CH2-CH—(CH═CH2)-CH2-CH═CH—CH2-CH2-CH—O—CH—CH2-OH).

In a further embodiment of the method of using, the hydroxyl terminated, epoxidized polybutadiene polymer (Poly BD 605E) is cured with isocyanate curatives selected from the group consisting of isophorone diisocyanate, hexamethylene diisocyanate, or 2,4,4-trimethylhexamethylene diisocyanate.

In yet another embodiment, the application relates to a method of making a Ramjet solid fuel, comprising the steps of combining up to 50% metal by weight selected from the group consisting of aluminum, boron, boron carbide, magnesium, titanium, and titanium boride; between 2.0 and 9.0 weight percent fluorinated combustion aids selected from the group consisting of 3-hydroxybenzo trifluoride (3HBTF), hydroxyfluoro-2-propanol ($HF_2P$) and up to 48% by weight of hydroxyl terminated, epoxidized polybutadiene polymer (Poly BD 605E) (HO—CH2-CH═CH—CH2-CH2-CH—O—CH—CH2-CH2-CH—(CH═CH2)-CH2-CH═CH—CH2-CH2-CH—O—CH—CH2-OH).

In a further embodiment of the method of making, the hydroxyl terminated, epoxidized polybutadiene polymer (Poly BD 605E) is cured with isocyanate curatives selected from the group consisting of isophorone diisocyanate, hexamethylene diisocyanate, or 2,4,4-trimethylhexamethylene diisocyanate.

To verify these methods and configurations, the following experiments were conducted and described in the Examples below.

EXAMPLES

Example 1

Various formulations based on the 605E polymer have been tested in over 150 2"×6" direct connect subscale tests, and in 10 full scale direct connect tests. These loadings were from 10% up to 50%.

The ten Tests were as follows: Test 1 was $B_4C$ (40%). Test 2 was $B_4C$ (4%). Test 3 was GUM (a polymer grain with no solid articulate loading). Test 4 was $B_4C$ (40%). Test 5 was Al (25%). Test 6 was Al (10%). Test 7 was Al (25%) Burst Disk Failure (test facility failure that reduced air flow into engine below requirement). Test 8 was Al (25%). Test 9 was Al (25%) (cured with isocyanate). Test 10 was Al (25%) (cured with isocyanate) and Inlet Temperature too low (test facility issue with incoming air temperature lower than requirement).

The repeatable results of these tests showed that these SFRJ formulation ignite consistently and demonstrate stable combustion over a wide range of chamber pressures, inlet air temperatures, and air mass flux values. In the full-scale testing, the formulations consistently auto-ignited without the need for a secondary ignition source. The measured combustion efficiencies and regression rates were equal to or better than pre-test predictions and showed exceptional repeatability.

Combustion testing of full scale SFRJ motor was conducted.

Example 2

Tests were conducted at simulated altitude and Mach number conditions for the same samples used in Examples 1 and 2.

While several embodiments have been described in detail, it will be apparent to those skilled in the art that the disclosed embodiments may be modified. Therefore, the foregoing description is to be considered exemplary rather than limiting.

What is claimed is:

1. A method of making a Ramjet solid fuel, comprising the steps of combining up to 50% metal by weight selected from the group consisting of aluminum, boron, boron carbide, magnesium, titanium, and titanium boride; between 2.0 and 9.0 weight percent fluorinated combustion aids selected from the group consisting of 3-hydroxybenzo trifluoride (3HBTF), hydroxyfluoro-2-propanol ($HF_2P$) and up to 48% by weight of hydroxyl terminated, epoxidized polybutadiene polymer (Poly BD 605E) (HO—CH2-CH═CH—CH2-CH2-CH—O—CH—CH2-CH2-CH—(CH═CH2)-CH2-CH═CH—CH2-CH2-CH—O—CH—CH2-OH).

2. The method of claim 1, wherein the hydroxyl terminated, epoxidized polybutadiene polymer (Poly BD 605E) is cured with isocyanate curatives selected from the group consisting of isophorone diisocyanate, hexamethylene diisocyanate, or 2,4,4-trimethylhexamethylene diisocyanate.

* * * * *